US006950162B2

(12) United States Patent
Kim

(10) Patent No.: US 6,950,162 B2
(45) Date of Patent: Sep. 27, 2005

(54) LIQUID CRYSTAL DISPLAY DEVICE AND METHOD OF DRIVING THE SAME

(75) Inventor: Pyung Hun Kim, Kyoungsangbuk-Do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 283 days.

(21) Appl. No.: 10/243,878

(22) Filed: Sep. 16, 2002

(65) Prior Publication Data

US 2003/0090602 A1 May 15, 2003

(30) Foreign Application Priority Data

Nov. 15, 2001 (KR) ..... 2001-71124

(51) Int. Cl.[7] ..... G02F 1/1343
(52) U.S. Cl. ..... 349/139; 349/38
(58) Field of Search ..... 349/38, 39, 139, 349/143, 110, 43; 345/96

(56) References Cited

U.S. PATENT DOCUMENTS 5,790,092 A * 8/1998 Moriyama ..... 345/96
6,091,464 A * 7/2000 Song ..... 349/38
6,327,008 B1 * 12/2001 Fujiyoshi ..... 349/106
6,342,876 B1 * 1/2002 Kim ..... 345/87
6,404,465 B1 * 6/2002 Nakayama et al. ..... 349/39

FOREIGN PATENT DOCUMENTS

JP 2001-282205 10/2001
KR 10-0349207 8/2002

* cited by examiner

*Primary Examiner*—Kenneth Parker
*Assistant Examiner*—David Chung
(74) *Attorney, Agent, or Firm*—McKenna Long & Aldridge LLP

(57) ABSTRACT

A liquid crystal display device includes a plurality of gate lines extending along a longitudinal direction and disposed at first intervals along a transverse direction, a plurality of data lines extending along the transverse direction to cross the plurality of gate lines, a first set of two adjacent data lines transmitting data signals of a first phase and a second set of two adjacent data lines transmitting data signals of a second phase inverted to the first phase, a plurality of pixels, each disposed in a pixel region defined by the crossing of the gate and data lines, and a plurality of thin film transistors, each connected to one of the plurality of pixels.

17 Claims, 9 Drawing Sheets

FIG. 3A
PRIOR ART

| m−2 | m−1 | m | m+1 | m+2 | |
|---|---|---|---|---|---|
| − | + | − | + | − | n−1 |
| + | − | + | − | + | n |
| − | + | − | + | − | n+1 |
| + | − | + | − | + | n+2 |
| − | + | − | + | − | n+3 |

ODD FRAME

FIG. 3B
PRIOR ART

| m−2 | m−1 | m | m+1 | m+2 | |
|---|---|---|---|---|---|
| + | − | + | − | + | n−1 |
| − | + | − | + | − | n |
| + | − | + | − | + | n+1 |
| − | + | − | + | − | n+2 |
| + | − | + | − | + | n+3 |

EVEN FRAME

FIG. 6A

| m−2 | m−1 | m | m+1 | m+2 | |
|---|---|---|---|---|---|
| − | + | − | + | − | n−1 |
| + | − | + | − | + | n |
| + | − | + | − | + | n+1 |
| − | + | − | + | − | n+2 |
| − | + | − | + | − | n+3 |

ODD FRAME

FIG. 6B

| m−2 | m−1 | m | m+1 | m+2 | |
|---|---|---|---|---|---|
| + | − | + | − | + | n−1 |
| − | + | − | + | − | n |
| − | + | − | + | − | n+1 |
| + | − | + | − | + | n+2 |
| + | − | + | − | + | n+3 |

EVEN FRAME

LIQUID CRYSTAL DISPLAY DEVICE AND METHOD OF DRIVING THE SAME

The present invention claims the benefit of Korean Patent Application No. 71124/2001 filed in Korea on Nov. 15, 2001, which is hereby incorporated by reference.

BACKGROUND OF THE INVENTION

1. Field of the Invention

The present invention relates to a liquid crystal display device, and particularly, to a 2-dot inversion liquid crystal display device that prevents cross talk and occurrence of a dim phenomenon along a transverse direction.

2. Description of the Background Art

Generally, a liquid crystal display (LCD) device is a transmissive type flat panel display device having a wide application to various electric devices, such as mobile phones, personal digital assistants (PDA), and notebook computers. The LCD device can be used as a small, light, and power-efficient device for superior image quality. Accordingly, the LCD device has practical application in digital television displays. In addition, the LCD device can be categorized according to the method it uses for moving liquid crystal molecules. However, an active matrix thin film transistor (TFT) LCD is commonly used due to its rapid reaction speed and low residual image generation.

FIG. 1 is a plan view of a liquid crystal display device according to the prior art. In FIG. 1, a TFT LCD panel 1 structure includes a plurality of gate lines 3 and data lines 5 arranged along longitudinal and transverse directions for defining a plurality of pixel regions, a thin film transistor (TFT) 7, which functions as a switching device, is disposed in each of the respective pixel regions, and a storage capacitor 11 electrically interconnected between the TFT 7 and a pixel electrode 9. The TFT 7 is switched when a scan signal is input via a corresponding one of the gate lines 3 to transmit the signal input through the data line 5 to the pixel electrode 9. Accordingly, an electric field is applied to a corresponding liquid crystal material by the pixel electrode 9 and a common electrode (not shown).

FIG. 2 is a cross-sectional of a pixel in the liquid crystal display device shown in FIG. 1 according to the prior art. In FIG. 2, a metal gate electrode 22 is formed on a transparent lower substrate 20, and a gate insulating layer 24 is formed on an entire surface of the lower substrate 20 upon which the gate electrode 22 is formed. A semiconductor layer 26 is formed on the gate insulating layer 24, and metal source/drain electrodes 28 are formed thereupon. In addition, a transparent metal pixel electrode 30, such as indium tin oxide (ITO), is formed upon the gate insulating layer 24 and is electrically connected to the source/drain electrode 28, and a passivation layer 32 is formed on the pixel electrode 30.

In FIG. 2, a black matrix 42, which functions as a light shielding layer to prevent deterioration of image quality by light leakage, is formed on an upper substrate 40 corresponding to a region of the gate electrode 22, and a color filter layer 44 is formed on an image representation region corresponding to the pixel electrode 30. A transparent metal common electrode 46 is formed on the black matrix 42 and on the color filter layer 44. A constant cell gap is maintained between the lower and upper substrates 20 and 40 by a spacer 52. Accordingly, the liquid crystal material is injected between the upper and lower substrates 40 and 20 to form a liquid crystal material layer 50. Although not shown in FIG. 2, alignment layers for aligning liquid crystal molecules of the liquid crystal material layer 50 are formed on the passivation layer 32 of the lower substrate 20 and on the common electrode 46 of the upper substrate 40.

In FIG. 2, a channel layer is formed in the semiconductor layer 26 by application of the scan signal on the gate electrode 22, whereby the data signal input from the data line 5 through the source/drain electrodes 28 is applied to the liquid crystal material layer 50. On the other hand, as shown in FIG. 1, each gate electrode 22 of the TFT 7 is electrically interconnected to the gate line 3. Accordingly, as the scan signal is applied to the gate line 3, channel layers of each of the semiconductor layers of each of the plurality of TFT 7 connected to the corresponding gate line 3 are formed, whereby transmitting the data signal input through the data line 5 to each of the corresponding pixel electrodes 9.

Methods of operating the liquid crystal panel 1 (in FIG. 1) may be divided into one of a line inversion method, a column inversion method, or a dot inversion method according to the phase of the data signal applied to the data line 5. The line inversion method applies the data signal to each of the data lines after inverting the phase of the data signal per each of the data lines, and the column inversion method sequentially applies the data signal to each of the data lines after inverting the phase of the data signal per each column. In addition, the dot inversion method simultaneously inverts the voltage polarity applied to the data line 5 on every column and every line. Due to deterioration of the liquid crystal material when the same voltage is continuously applied between the pixel electrode and the common electrode, the phase of the data signal is inverted and the data signal is applied to the data line 5 in order to prevent a cross-talk phenomenon on the display screen when the liquid crystal display device is fabricated.

FIGS. 3A and 3B show driving methods of an odd frame and an even frame in a liquid crystal display device of dot inversion method according to the prior art. In the dot inversion method, the amount of cross-talk is relatively less in the dot inversion method than cross-talk in the line inversion method or in the column inversion method. Accordingly, the dot inversion method produces a higher image quality. In FIGS. 3A and 3B, when a positive (+) pixel voltage is applied to an (m,n) pixel in an odd frame, a negative (−) pixel voltage is applied to an adjacent (m, n+1) pixel. In addition, when the negative (−) pixel voltage is applied to the (m,n) pixel in an even frame, the positive (+) pixel voltage is applied to an (m,n+1) pixel. In a case where a voltage decrease occurs in the positive pixel electrode of the (m,n) pixel during a predetermined period (i.e., an odd frame), the negative pixel voltage is applied to the (m,n) pixel at a next even frame. Accordingly, the voltage decrease may be compensated.

FIG. 4 shows a panel structure of a liquid crystal display device using the dot inversion method according to the prior art. In FIG. 4, in order to operate the liquid crystal display device using the dot inversion method, a first data driving integrated circuit (IC) 62 and a second data driving IC 64 are provided for dividing a data driving IC for applying the data signal to the data line 5. The data lines of odd rows are connected to the first data driving IC 62, and the data lines of even rows are connected to the second data driving IC 64. Accordingly, the scan signal is applied to the respective TFT 7 through a gate driving IC 60, whereby the pixel voltages of different phases are applied to adjacent pixel electrodes.

FIG. 5 is a signal waveform of a liquid crystal display device of dot inversion method according to the prior art. In FIG. 5, as the scan signal is input to an n-th gate line 3 through the gate driving IC 60 (in FIG. 4), a channel region is formed in the semiconductor layer of the TFT 7 (in FIG. 4) to supply a data signal of one of the first data driving IC 62 and the second date driving IC 64 to a corresponding pixel electrode via a source/drain electrode of the TFT 7. Accordingly, a positive pixel voltage and a negative pixel voltage are applied to adjacent the pixel electrodes (i.e., (m,n) pixel and (m,n+1) pixel).

In FIG. 5, $\Delta V_p$ is a feedthrough voltage, which is a voltage lowering value of the pixel voltage caused by a parasitic capacitance generated between the gate electrode and the source/drain electrode, and by the parasitic capacitance generated between the data line 5 and the pixel electrode. In addition, $\Delta V_{pp}$ is a voltage variation value caused by a coupling capacitance generated between the adjacent pixel electrodes. During the dot inversion method, the positive pixel voltage is applied to the (m,n) pixel in the odd frame, and the negative pixel voltage is applied to the (m,n) pixel in the even frame. In addition, the negative pixel voltage is applied to the (m,n+1) pixel that is adjacent to the (m,n) pixel in the odd frame, and the positive pixel voltage is applied to the (m,n+1) pixel in the even frame. Therefore, since the (m,n) pixel to which the positive pixel voltage is applied in the odd frame is adjacent to the (m,n+1) pixel to which the negative pixel voltage is applied in the odd frame, the effective voltage of the (m,n) pixel is lowered by the dislocation of the adjacent pixel (m,n+1) by a value of $\Delta V_{pp}$. However, the effective voltage of the pixel (m,n+1) is correspondingly increased by the value of $\Delta V_{pp}$ by the dislocation of the adjacent (m,n) pixel. Accordingly, the (m,n) pixel and the (m,n+1) pixel are conversely operated when the odd frame is changed into the even frame, whereby the effective voltage of the (m,n) pixel is increased by the value of $\Delta V_{pp}$ and the effective voltage of the (m,n+1) pixel is reduced by the value of $\Delta V_{pp}$.

By using the dot inversion method for driving the liquid crystal display device the effective voltages of the pixels to which the positive pixel voltage is applied are reduced as $\Delta V_{pp}$, and the effective voltages of the pixels to which the negative pixel voltage is applied are increased as $\Delta V_{pp}$. Thus, all the pixels have voltage dislocation values that are reduced at a side opposite to the applied pixel electrodes due to the coupling effect between the adjacent pixels. Accordingly, a luminance difference between the pixels is not generated and the cross-talk is not generated on the display screen. However, for low power consumption liquid crystal display devices, the phases of data signals applied to the respective pixels should be inverted in the dot inversion method described above.

SUMMARY OF THE INVENTION

Accordingly, the present invention is directed to a liquid crystal display device and method of driving a liquid crystal display device that substantially obviates one or more of the problems due to limitations and disadvantages of the related art.

An object of the present invention is to provide a liquid crystal display device of a 2-dot inversion method to prevent generation of cross-talk on a display screen.

Another object of the present invention is to provide a liquid crystal display device of a 2-dot inversion method to prevent generation of a dim phenomenon.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the present invention, as embodied and broadly described, a liquid crystal display device includes a plurality of gate lines extending along a longitudinal direction and disposed at first intervals along a transverse direction, a plurality of data lines extending along the transverse direction to cross the plurality of gate lines, a first set of two adjacent data lines transmitting data signals of a first phase and a second set of two adjacent data lines transmitting data signals of a second phase inverted to the first phase, a plurality of pixels, each disposed in a pixel region defined by the crossing of the gate and data lines, and a plurality of thin film transistors, each connected to one of the plurality of pixels.

In another aspect, a method for driving a liquid crystal display device including a plurality of pixels, each pixel formed between a plurality of gate lines and data lines, and including a thin film transistor respectively, includes steps of applying data signals of a first phase to a first set of two adjacent pixel electrodes disposed along a longitudinal direction, and applying data signals of a second phase inverted to the first phase to a second set of two adjacent pixel electrodes adjacent to the first set of two adjacent pixel electrodes, wherein a first coupling capacitance of about $1.5\sim2.3\times10^{-15}$ (F/pixel) is formed between the first set of adjacent pixel electrodes along the longitudinal direction.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIGS. 3A and 3B show driving methods of an odd frame and an even frame in a liquid crystal display device of dot inversion method according to the prior art;

FIGS. 6A and 6B show exemplary driving methods of odd frame and even frame in an exemplary liquid crystal display device of 2-dot inversion method according to the present invention;

DETAILED DESCRIPTION OF THE PREFERRED EMBODIMENTS

Reference will now be made in detail to the preferred embodiments of the present invention, examples of which are illustrated in the accompanying drawings.

FIGS. 6A and 6B show exemplary driving methods of odd frame and even frame in an exemplary liquid crystal display device of a 2-dot inversion method according to the present invention. In FIGS. 6A and 6B, a 2-dot inversion method applies pixel voltages having same phases to two adjacent pixels along a data line direction, and applies pixel voltages having inverted phases to two adjacent pixels different from to the two adjacent pixels along the date line direction. In FIG. 6A, a positive (+) pixel voltage may be applied to a first set of (m,n) and (m,n+1) pixels, which may be adjacent along a longitudinal direction, and a negative (−) pixel voltage may be applied to a second set of (m+1,n) and (m+1,n+1) pixels, which are adjacent to the two longitudinally adjacent pixels. In FIG. 6B, the phases are inverted, whereby the negative pixel voltage is applied to the first set of longitudinally adjacent (m,n) and (m,n+1) pixels, and the positive pixel voltage is applied to the second set of (m+1,n) and (m+1,n+1) pixels.

Figure 1:
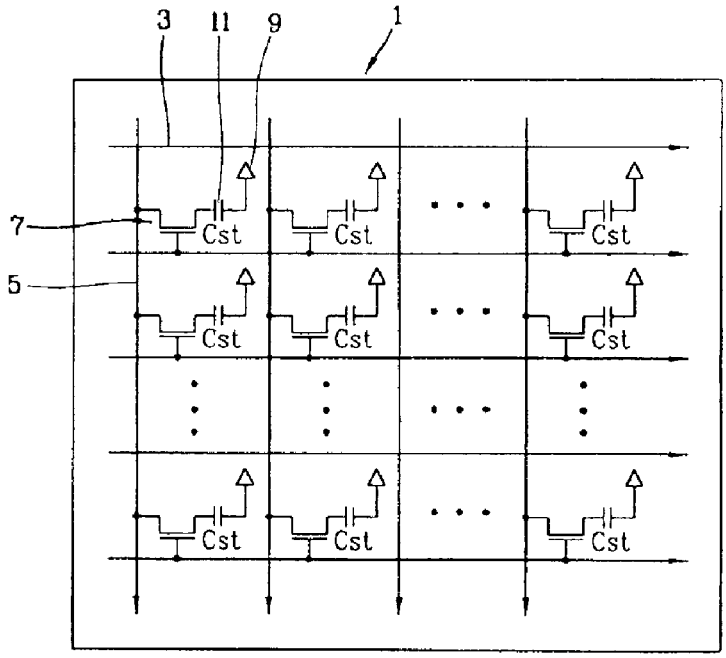
FIG. 1 PRIOR ART
FIG. 1 is a plan view of a liquid crystal display device according to the prior art.
Figure 2:
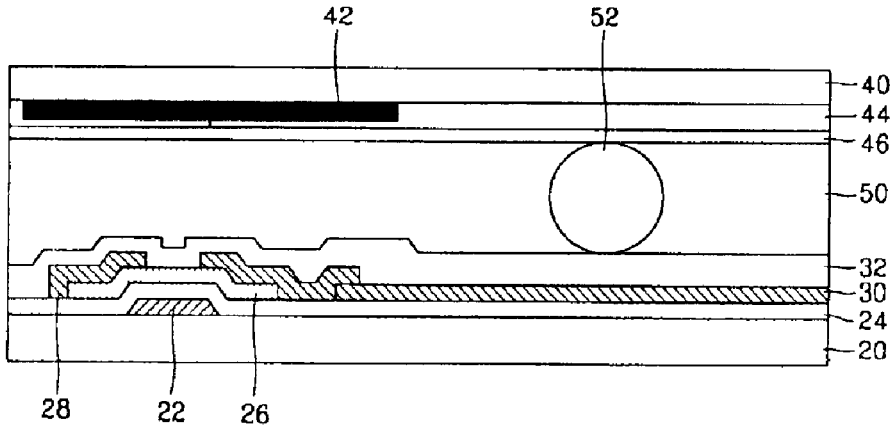
FIG. 2 PRIOR ART
FIG. 2 is a cross-sectional view of a pixel in the liquid crystal display device shown in FIG. 1 according to the prior art.
Figure 4:
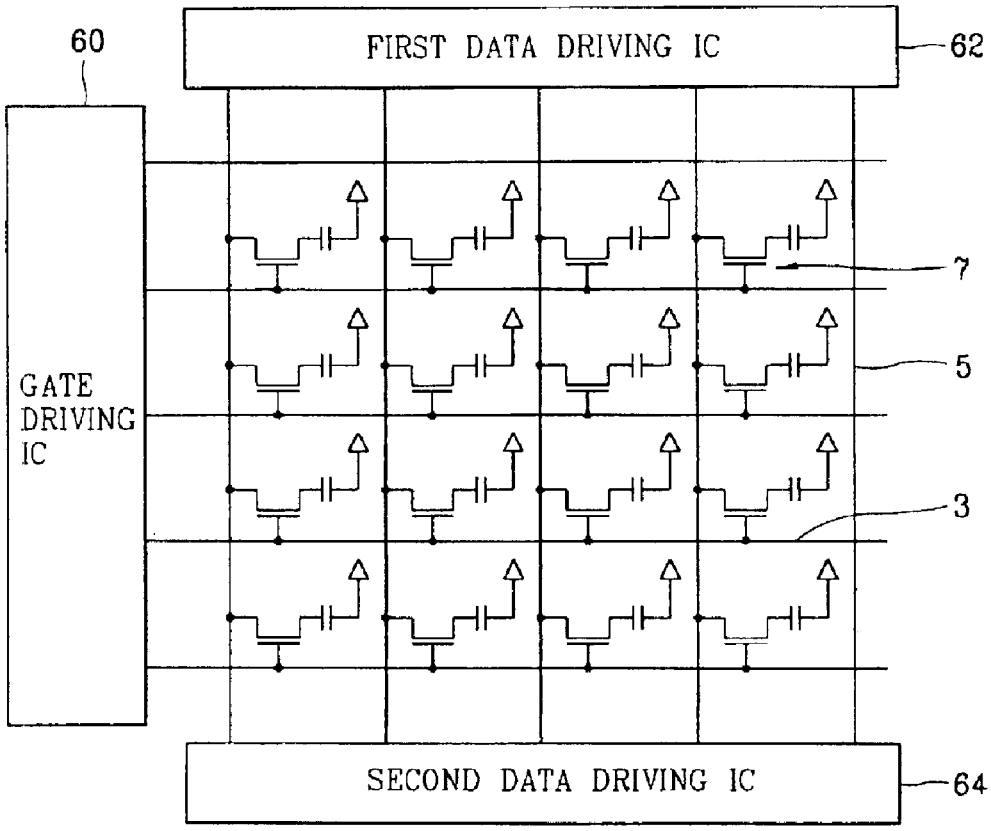
FIG. 4 PRIOR ART
FIG. 4 shows a panel structure of a liquid crystal display device of dot inversion method according to the prior art.
Figure 5:
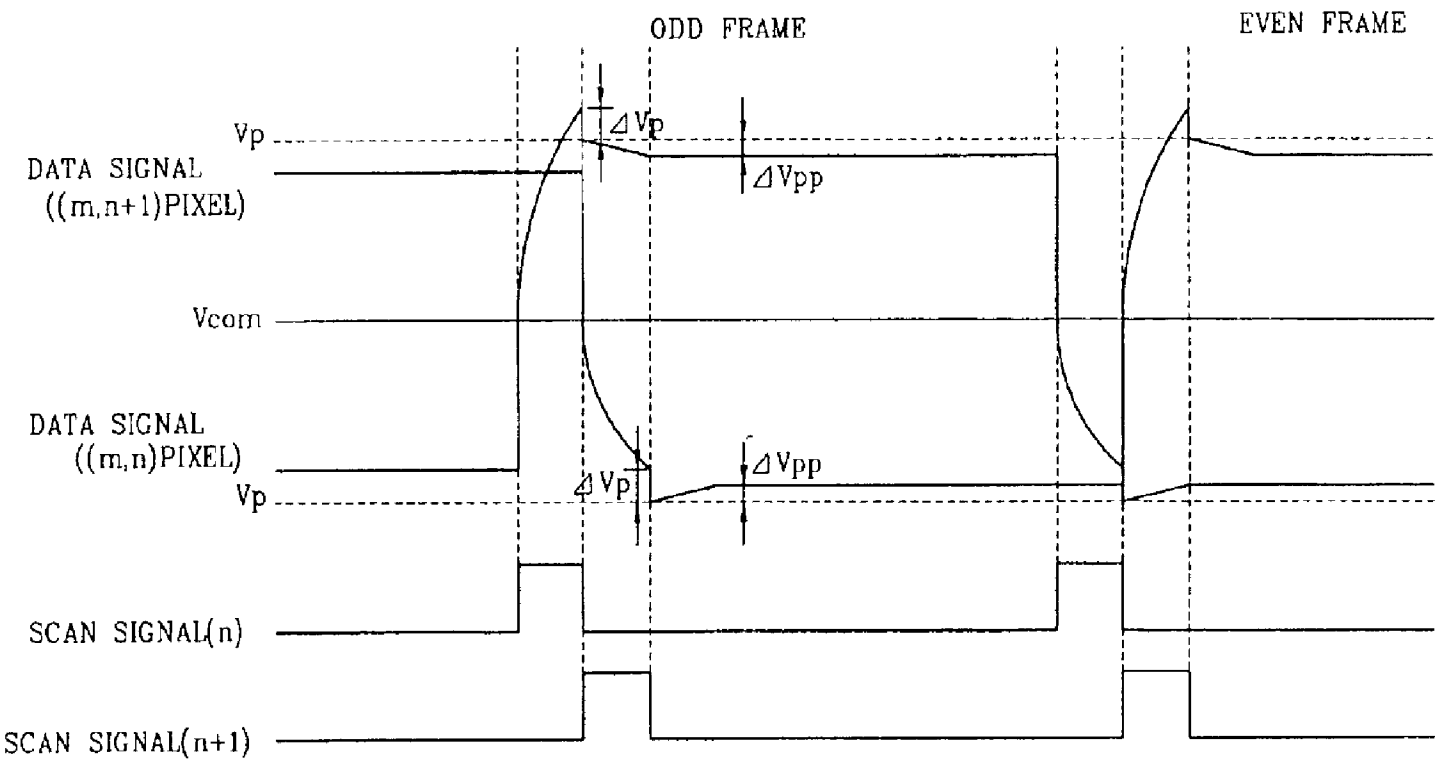
FIG. 5 PRIOR ART
FIG. 5 is a signal waveform of a liquid crystal display device of dot inversion method according to the prior art.
Figure 7:
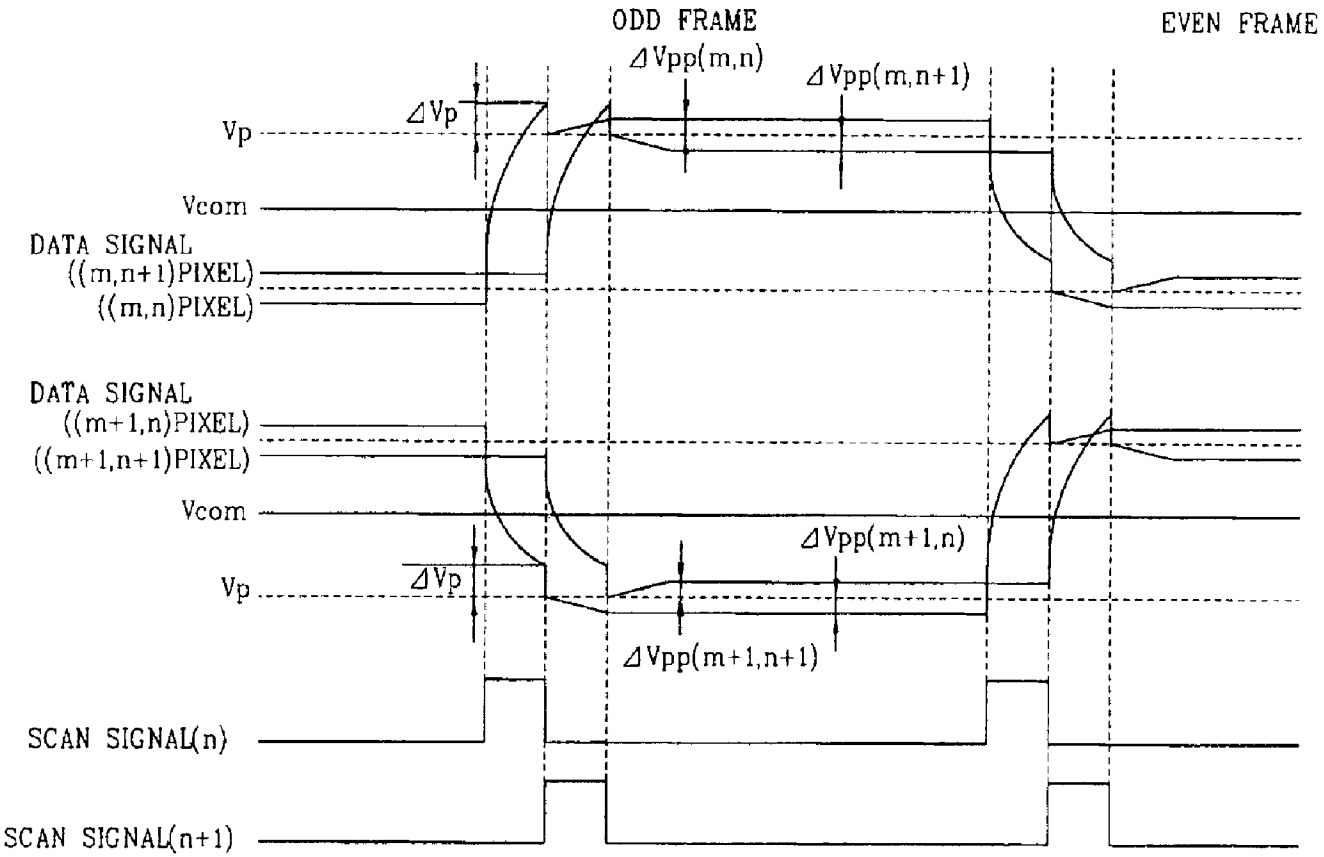
FIG. 7 is a signal waveform of an exemplary liquid crystal display device of 2-dot inversion method according to the present invention.

FIG. 7 is a signal waveform of an exemplary liquid crystal display device of 2-dot inversion method according to the present invention. In FIG. 7, as a scan signal may be input through an n-th gate line from a gate driving IC in an odd frame, a positive pixel voltage may be applied to a first set of adjacent (m,n) and (m,n+1) pixels connected to the n-th gate line, and a negative pixel voltage may be applied to a second set of adjacent (m+1,n) and (m+1,n+1) pixels. Conversely, as a scan signal may be input through an n-th gate line from a gate driving IC in an even frame, a negative pixel voltage may be applied to the first set of adjacent (m,n) and (m,n+1) pixels connected to the n-th gate line, and a positive pixel voltage may be applied to the second set of adjacent (m+1,n) and (m+1,n+1) pixels in an even frame.

During input of the scan signal, the voltages applied to the respective pixels is varied by feedthrough voltage ($\Delta V_p$). The feedthrough voltage ($\Delta V_p$) may be generated by a parasitic capacitance, and may be expressed as:

$$\Delta V_p = \frac{C_{gd}}{C_{total}} \times \Delta V_g \tag{1}$$

Here, $C_{total}=C_{gs}+C_{st}+C_{lc}+C_{dp}+C_{gd}$, wherein $C_{gs}$ represents a parasitic capacitance generated between the gate electrode and the source electrode of the TFT disposed in the pixel, $C_{st}$ represents the storage capacitance, $C_{lc}$ represents the capacitance by the liquid crystal material, $C_{dp}$ represents the parasitic capacitance generated between the data line and the pixel electrode, and $C_{gd}$ represents the parasitic capacitance generated between the gate electrode and the drain electrode of TFT, and $\Delta V_g$ represents the gate voltage.

In general, since the parasitic capacitance generated on the pixel may increase over time, the feedthrough voltage $\Delta V_p$ may increase. Consequently, the pixel voltage applied to the pixel may be lowered. In addition, a voltage variation value $V_{pp}$ may be caused by the capacitance in the pixel, the pixel voltage of adjacent pixel, and the coupling capacitance $C_{pp}$ by the coupling effect between adjacent pixels. Accordingly, an effective voltage of the respective pixel may be changed by the voltage variation value $V_{pp}$.

In FIG. 7, the effective voltage of the (m,n) pixel to which the positive pixel voltage is applied in the odd frame may increase by as much as the voltage variation value $V_{pp}$ more than the pixel voltage $V_p$. Accordingly, the effective voltage of the (m,n) pixel may be increased, since the positive pixel voltage is applied to the adjacent (m,n+1) pixel. Thus, the effective voltage may be increased as much as the voltage variation value $V_{pp}$ by the voltage increase of the adjacent pixel. Conversely, the effective voltage applied to the (m,n+1) pixel may be reduced by as much as the voltage variation value $V_{pp}$ less than the pixel voltage $V_p$ according to the voltage lowering of the adjacent (m,n+2) pixel. In addition, the effective voltage of the (m+1,n) pixel to which the negative pixel voltage is applied may be reduced by as much as the voltage variation value $V_{pp}$ less than the pixel voltage $V_p$ according to the voltage lowering of the adjacent (m+1, n+1) pixel. Likewise, the effective voltage of the (m+1, n+1) pixel may be increased by as much as the voltage variation value $V_{pp}$ by the voltage increasing of the adjacent (m+1, n+2) pixel.

In the (m,n) pixel to which the positive pixel voltage is applied, the effective voltage may be increased by as much as the voltage variation value $V_{pp}$ more than the pixel voltage $V_p$, and therefore a voltage amount $|V_p+V_{pp}|$ larger than the pixel voltage may be applied. In addition, in the (m+1,n) pixel to which the negative pixel voltage is applied, the effective voltage may be reduced by as much as the voltage variation value $V_{pp}$ less than the pixel voltage $V_p$, and therefore a voltage amount $|-V_p-V_{pp}|$ larger than the pixel voltage may be applied. Accordingly, the effective voltages applied to the (m,n) pixel and to the (m+1,n) pixel may be larger than the pixel voltages (data signals) which are applied through the data line. Conversely, an effective voltage amount $|V_p-V_{pp}|$ may be applied to the (m,n+1) pixel, and an effective voltage amount $|-V_p+V_{pp}|$ may be applied to the (m+1, n+1) pixel.

The effective voltages that are larger than the pixel voltages may be applied to the (m,n) pixel and to the (m+1,n) pixel, which are connected an n-th gate line, and the effective voltages that are smaller than the pixel voltages may be applied to the (m,n+1) pixel and the (m+1, n+1) pixel, which are connected to an $n+1^{st}$ gate line. Moreover, the effective voltage that is larger than the pixel voltage may be applied to every pixel connected to the n-th gate line, and the effective voltage that is smaller than the pixel voltage may be applied to every pixel connected to the $n+1^{st}$ gate line. Furthermore, if the effective voltage that is larger than the pixel voltage (i.e., $|V_p+V_{pp}|$) may be applied to the pixel electrode in a pixel connected to a first gate line, then the effective voltage that is smaller than the pixel voltage (i.e., $|V_p-V_{pp}|$) may be applied to the pixel connected to a gate line adjacent to the first gate line.

Since the effective voltages of a first series of pixels arranged along the n-th gate line and of a second series of pixels arranged along with the $n+1^{st}$ gate line are different from each other, the transmittances of the pixels on the n-th gate line and of the pixels on the $n+1^{st}$ gate line are also different from each other. Therefore, a luminance difference is generated along the gate line direction in the liquid crystal display device using the 2-dot inversion method, thereby generating a dim phenomenon on the display screen of the device. Thus, in order to apply the 2-dot inversion driving method to a liquid crystal display device of low power consumption, the dim phenomenon must be resolved.

The voltage variation value $V_{pp}$ generated in the 2-dot inversion method is due to capacitance of the pixel, the pixel voltage of an adjacent pixel, and by the coupling effect between adjacent pixels. The voltage variation value $V_{pp}$ is a variation value of pixel voltage which is applied to the (m,n) pixel and may be expressed as:

$$\Delta V_{pp} = \frac{C_{pp}}{C_{total}} \times \Delta V_{data} \quad (2)$$

Here, $C_{total}$ represents an entire capacitance of the pixel, $C_{pp}$ represents the coupling capacitance caused by the coupling effect between the (m,n) pixel and the adjacent (m,n+1) pixel, and $\Delta V_{data}$ represents a change amount of pixel voltage applied to the (m,n+1) pixel. The voltage variation value $V_{pp}$ of a pixel may be varied from the entire capacitance of the pixel, the changed amount of the pixel voltage in the adjacent pixel, and the coupling capacitance generated between adjacent pixels. In general, the voltage variation value $V_{pp}$ of a pixel may actually be difficult to control. However, it may be relatively easy to control the coupling capacitance between the adjacent pixels.

The dim phenomenon may be controlled in a liquid crystal display device driven by the 2-dot inversion method by controlling the coupling capacitance between the adjacent pixels. The dim phenomenon in a liquid crystal display device driven by the 2-dot inversion method is caused by a luminance difference between the effective voltages applied to the pixels connected to the respective gate lines. However, fine dim phenomenon generated on a display screen may not be significant since it is not easily recognizable to the user/viewer. Accordingly, even though the dim phenomenon may be generated on the display screen, it can be tolerable when the user is unable to detect or recognize the dim phenomenon. Therefore, the coupling capacitance (one of the elements affecting the size of an effective voltage) between the pixels is controlled to reduce the dim phenomenon so that the user is unable to recognize the dim phenomenon.

The coupling capacitance $C_{pp}$ between pixels may be about $1.5\sim2.3\times10^{-15}$ F/pixel, and more desirably to be about $1.88\times10^{-15}$ F/pixel so that the user is unable to detect to recognize the dim phenomenon shown on the display screen. The coupling capacitance $C_{pp}$ may be formed between the pixel electrodes formed on the adjacent pixels. Thus, in order to control the coupling capacitance $C_{pp}$, a gap between the pixel electrodes on the adjacent pixels may be controlled.

Figure 8:
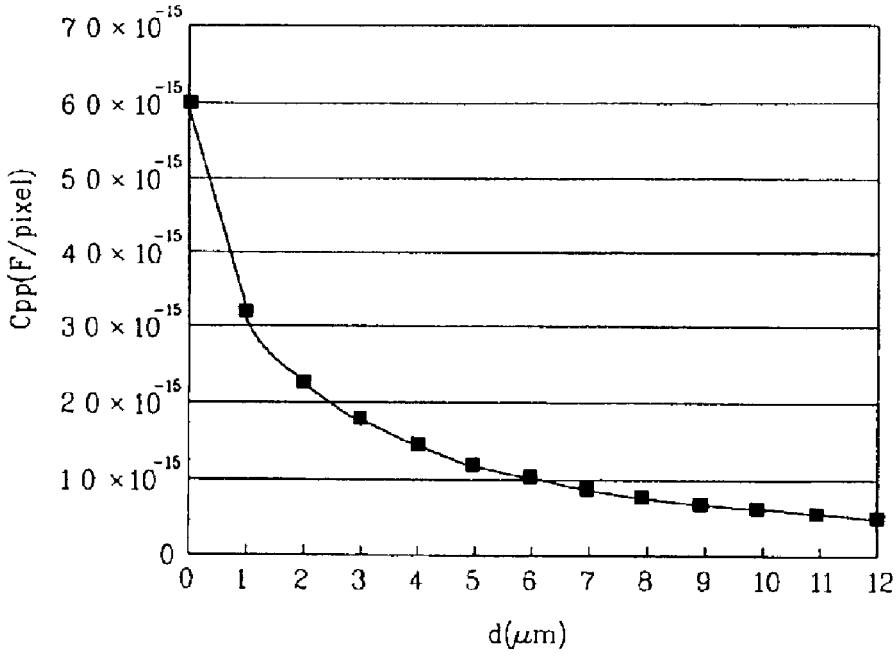
FIG. 8 is a graph showing a coupling capacitance ($C_{pp}$) relation between a gap of adjacent pixel electrodes or a gap of pixel electrode and metal layer for a storage capacitor and a pixel according to the present invention.

FIG. 8 is a graph showing a coupling capacitance ($C_{pp}$) relation between a gap of adjacent pixel electrodes or a gap of pixel electrode and metal layer for a storage capacitor and a pixel according to the present invention. In FIG. 8, as a gap between pixel electrodes increases, a coupling capacitance $C_{pp}$ is non-linearly reduced. Accordingly, to form a coupling capacitance $C_{pp}$ of about $1.5\sim2.3\times10^{-15}$ (F/pixel), the gap between adjacent pixel electrodes should be maintained to be about 2.4~4 $\mu$m.

In Equation 2, the voltage variation value $V_{pp}$ of the effective voltage applied to the pixel may be proportional to the coupling capacitance $C_{pp}$, and the coupling capacitance $C_{pp}$ may be non-linear inversely proportional to the gap between the pixel electrodes as shown in FIG. 8. Accordingly, the voltage variation value $V_{pp}$ may be reduced by forming the gap between pixel electrodes to be larger than a critical value, thereby reducing the variation in the effective voltage.

Figure 9A:
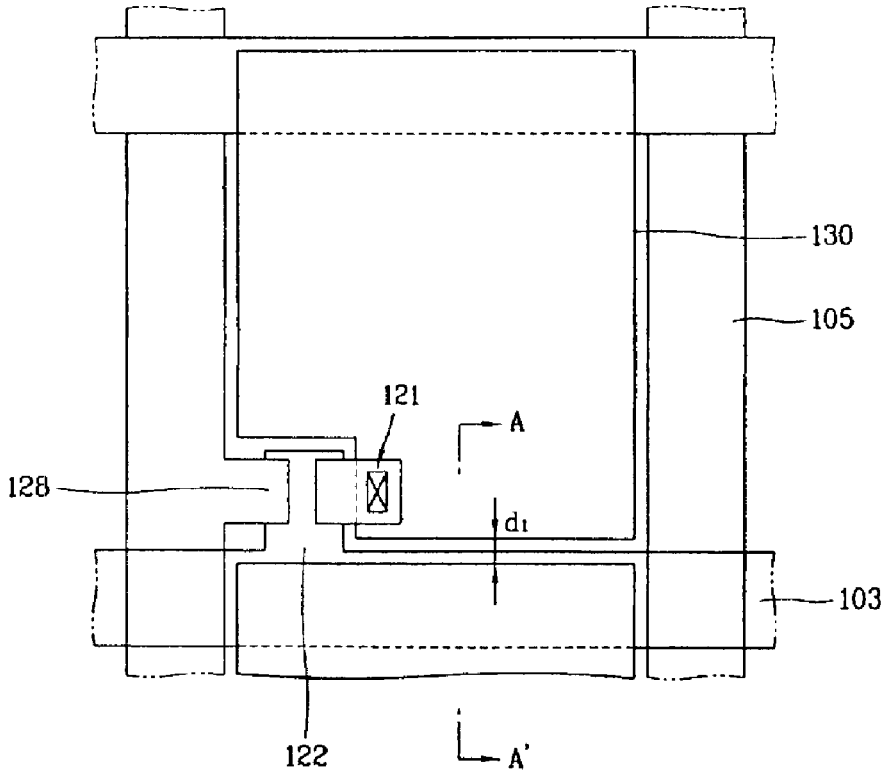
FIG. 9A is a plan view of an exemplary liquid crystal display device of 2-dot inversion method according to the present invention.
Figure 9B:
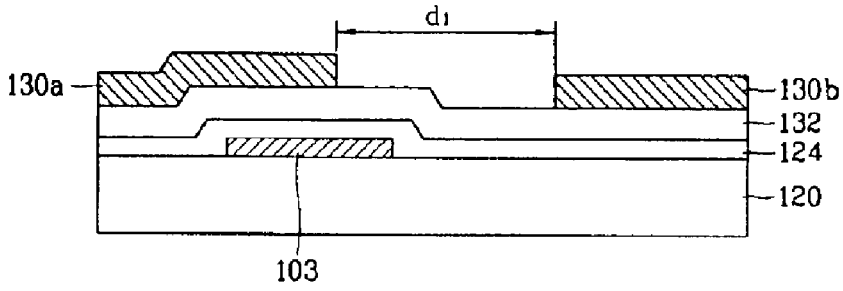
FIG. 9B is a cross-sectional view of the exemplary liquid crystal display device of FIG. 9A along line A–A'.

FIG. 9A is a plan view of an exemplary liquid crystal display device of 2-dot inversion method according to the present invention, and FIG. 9B is a cross-sectional view of the exemplary liquid crystal display device of FIG. 9A along line A–A'.

In FIG. 9A, a gate line 103 and a data line 105 may be arranged along longitudinal and transverse directions with a pixel electrode 130 formed in a pixel region formed between the gate and data lines 103 and 105. A gate electrode 122 of a TFT may be connected to the gate line 103, and a source/drain electrode 128 may be connected to the data line 105. The pixel electrode 130 may include a transparent metal, such as ITO, for example, and may be connected to the source/drain electrode 128 through a contact hole 121. Although it is not specifically shown in FIG. 9A, a semiconductor layer may be formed between the gate electrode 122 and the source/drain electrode 128, and a channel layer may be formed as the scan signal is applied to the gate electrode 122 through the gate line 103. In addition, the data signal input through the data line 105 may be applied to the pixel electrode 130 through the source/drain electrode 128.

In FIG. 9B, the gate line 103 may overlap a pixel electrode of an adjacent pixel along the longitudinal direction. The gate line 103, which is formed simultaneously with the gate electrode 122 of the TFT, may be positioned on a lower substrate 120 made of a transparent material such as glass, for example, and a gate insulating layer 124 may be formed on the entire surface of the lower substrate 120. A passivation layer 132 may be formed to cover the TFT and the gate insulating layer 124, and a first and second adjacent pixel electrodes 130*a* and 103*b* may be formed on the passivation layer 132. A portion of the first pixel electrode 130*a* may overlap at least a portion of the gate line 103 of an adjacent pixel along the longitudinal direction or along the data line direction. The coupling capacitance $C_{pp}$ may be formed between the second pixel electrode 130*b* and the first pixel electrode 130*a*. Accordingly, the coupling capacitance may be formed to be about $1.5\sim2.3\times10^{-15}$ (F/pixel), and more desirably about $1.88\times10^{-15}$ (F/pixel). In addition, a gap d1 between the adjacent first and second pixel electrodes 130*a* and 103*b* may be formed to be about 2.4~4 $\mu$m, and more desirably to be about 3 $\mu$m.

When the coupling capacitance $C_{pp}$ is less than about $1.5\times10^{-15}$ (F/pixel), the gap d1 between the first and second pixel electrodes 130*a* and 130*b* may be larger than about 4 $\mu$m, and an aperture rate of the liquid crystal display device may be lowered. When the coupling capacitance $C_{pp}$ is higher than about $2.3\times10^{-15}$ (F/pixel), lowering the voltage variation value $V_{pp}$ of the effective voltage does not work. Thus, the coupling capacitance $C_{pp}$ may be set to be about $1.5\sim2.3\times10^{-15}$ (F/pixel).

Accordingly, the coupling capacitance $C_{pp}$ may be about $1.5\sim2.3\times10^{-15}$ (F/pixel), and more desirably may be about $1.88\times10^{-15}$ (F/pixel) by forming the gap d1 between the first and second pixel electrodes 130*a* and 130*b* formed in the adjacent pixels to be about 2.4~4 $\mu$m, and more desirably may be about 3 $\mu$m. Thus, when the liquid crystal display device that uses the 2-dot inversion method is fabricated, the dim phenomenon along the transverse direction (i.e., data line direction) may be reduced to unrecognizable to the user.

In general, the coupling capacitance $C_{pp}$ between adjacent pixels may be generated by the pixel electrodes formed within a pixel region. However, in a liquid crystal display device having a metal layer for a storage capacitor, a coupling capacitance $C_{pp}$ may not be formed between the pixel electrodes of adjacent pixels, but formed between the pixel electrode and the metal layer for the storage capacitor.

Figure 10A:
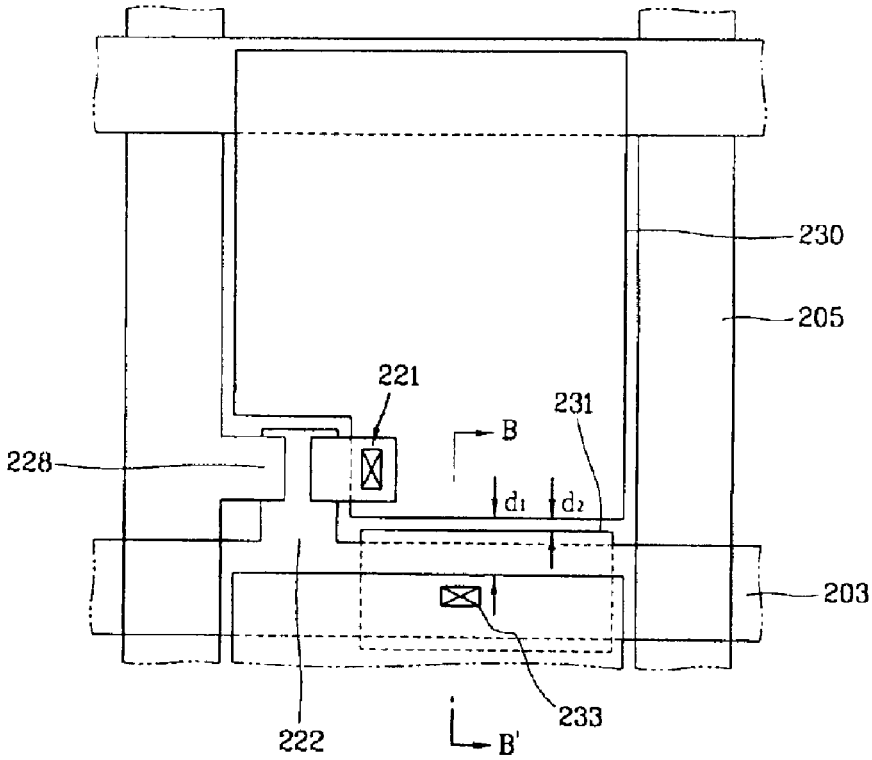
FIG. 10A is a plan view of another exemplary liquid crystal display device of 2-dot inversion method according to the present invention.
Figure 10B:
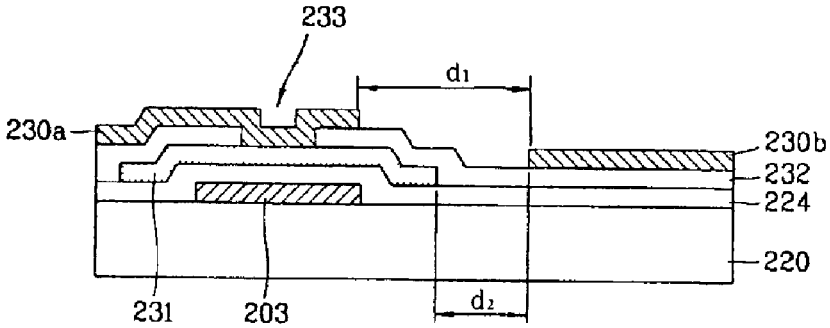
FIG. 10B is a cross-sectional view of the exemplary liquid crystal display device of FIG. 10A along line B–B'.

FIG. 10A is a plan view of another exemplary liquid crystal display device of 2-dot inversion method according to the present invention, and FIG. 10B is a cross-sectional view of the exemplary liquid crystal display device of FIG. 10A along line B–B'.

In FIG. 10A, a metal layer 231 for a storage capacitor may be formed on a gate insulating layer 224 (in FIG. 10B) having a width larger than a width of a gate line 203 (in FIG. 10B), and a having passivation layer 232 (in FIG. 10B) formed thereon. A contact hole 233 may be formed on the passivation layer 232, and the metal layer 231 for the storage capacitor may be connected to a first pixel electrode 230*a* (in FIG. 10B) of an adjacent pixel to form a storage capacitance $C_{st}$.

In FIG. 10B, a coupling capacitance $C_{pp}$ may be formed between a second pixel electrode 230*b* and the metal layer 231 for the storage capacitor. Thus, the coupling capacitance $C_{pp}$ may be controlled by a gap d1 between the first and second pixel electrodes 230*a* and 230*b*. However, the coupling capacitance $C_{pp}$ may be controlled by controlling a gap d2 between the second pixel electrode 230*b* and the metal layer 231. The gap d2 between the second pixel electrode 230*b* and the metal layer 231 may be formed to be about 2.4~4 μm to form a coupling capacitance $C_{pp}$ of about $1.5\sim2.3\times10^{-15}$ (F/pixel). Accordingly, to reduce the dim phenomenon so that the user is unable to recognize the dim phenomenon in the liquid crystal display device driven by the 2-dot inversion method, the coupling capacitance generated by the coupling effect between pixels may be formed to be about $1.5\sim2.3\times10^{-15}$ (F/pixel), and more desirably to be about $1.88\times10^{-15}$ (F/pixel). Moreover, the gap d1 between the first and second pixel electrodes 230*a* and 230*b* and the gap d2 between the second pixel electrode 230*b* and the metal layer 231 may be formed to be about 2.4~4 μm, and more desirably to be about 3 μm.

However, the gap d1 between the first and second pixel electrodes 230*a* and 230*b* or the gap d2 between the second pixel electrode 230*b* and the metal layer 231 may not necessarily have to be fixed to a certain value so long as the coupling capacitance $C_{pp}$ between the first and second pixel electrodes 230*a* and 230*b* to be about $1.5\sim2.3\times10^{-15}$ (F/pixel). Furthermore, the gap d2 between the second pixel electrode 230*b* and the metal layer 231 for obtaining the coupling capacitance about $1.5\sim2.3\times10^{-15}$ (F/pixel) may be changed according to a size or structure of a display panel in the liquid crystal display device driven by the 2-dot inversion method.

It will be apparent to those skilled in the art that various modifications can be made in the liquid crystal display device of the present invention without departing from the spirit or scope of the invention. Thus, it is intended that the present invention cover the modifications and variations of this invention provided they within the scope of the appended claims and their equivalents.

What is claimed is:

1. A liquid crystal display device, comprising:

a plurality of gate lines extending along a longitudinal direction and disposed at first intervals along a transverse direction;

a plurality of data lines extending along the transverse direction to cross the plurality of gate lines, a first set of two adjacent data lines transmitting first data signals of a first phase and a second set of two adjacent data lines transmitting second data signals of a second phase inverted to the first phase;

a plurality of pixels, each disposed in a pixel region defined by the crossing of the gate and data lines, the pixel including a pixel electrode; and a plurality of thin film transistors, each connected to one of the plurality of pixels, wherein a coupling capacitance of about $1.5\sim2.3\times10^{-15}$ (F/pixel) is formed between the first set of adjacent pixel electrodes along the longitudinal direction.

2. The device according to claim 1, wherein each of the plurality of thin film transistors include a gate electrode formed on a transparent substrate, a gate insulating layer formed on the gate electrode, a semiconductor layer formed on the gate insulating layer, a source/drain electrode formed on the semiconductor layer, and a passivation layer formed on the source/drain electrode.

3. The device according to claim 2, wherein the pixel electrode is connected with the source/drain electrode of the thin film transistor.

4. The device according to claim 1, wherein portions of each of the plurality of pixel electrodes overlap with portions of each of the plurality of gate lines of adjacent ones of the plurality of pixel electrodes.

5. The device according to claim 1, wherein a gap between adjacent ones of the plurality of pixel electrodes is about 2.4~4 μm.

6. The device according to claim 1, wherein a coupling capacitance between adjacent ones of the plurality of pixel electrodes is about $1.88\times10^{-15}$ (F/pixel).

7. The device according claim 6, wherein a gap between the adjacent ones of the plurality of pixel electrodes is about 3 μm.

8. The device according to claim 1, further including a metal layer formed on the gate insulating layer and overlying one of the plurality of gate lines, and electrically connected to one of the plurality of pixel electrodes for forming a storage capacitor with the gate line.

9. The device according to claim 8, wherein a gap between the metal layer and the pixel electrode is about 2.4~4 μm.

10. The device according to claim 9, wherein the gap between the metal layer and the pixel electrode is about 3 μm.

11. A method for driving a liquid crystal display device comprising a plurality of pixels, each pixel formed between a plurality of gate lines and data lines, and including a thin film transistor respectively, the method including steps of:

applying data signals of a first phase to a first set of two adjacent pixel electrodes disposed along a longitudinal direction; and applying data signals of a second phase inverted to the first phase to a second set of two adjacent pixel electrodes adjacent to the first set of two adjacent pixel electrodes, wherein a first coupling capacitance of about $1.5\sim2.3\times10^{-15}$ (F/pixel) is formed between the first set of adjacent pixel electrodes along the longitudinal direction.

12. The method according to claim 11, wherein the first coupling capacitance is about $1.88\times10^{-15}$ (F/pixel).

13. The method according to claim 11, wherein a gap between the first set of pixel electrodes along the longitudinal direction is about 2.4~4 μm.

14. The method according to claim 13, wherein the gap is about 3 μm.

15. The method according to claim 11, wherein the liquid crystal display device further includes a metal layer formed on one of the gate lines, wherein a second coupling capacitance is formed between the metal layer and one of the first and second sets of adjacent pixel electrodes.

16. The method according to claim 15, wherein a gap between the one of the first and second sets of adjacent pixel electrodes and the metal layer is about 2.4~4 μm.

17. The method according to claim 16, the gap is about 3 μm.

* * * * *